US008190041B2

(12) United States Patent
Kumagai

(10) Patent No.: US 8,190,041 B2
(45) Date of Patent: May 29, 2012

(54) IMAGE FORMING APPARATUS

(75) Inventor: Naohiro Kumagai, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 334 days.

(21) Appl. No.: 12/204,449

(22) Filed: Sep. 4, 2008

(65) Prior Publication Data

US 2009/0060536 A1 Mar. 5, 2009

(30) Foreign Application Priority Data

Sep. 5, 2007 (JP) ..... 2007-230341

(51) Int. Cl.
*G03G 21/12* (2006.01)

(52) U.S. Cl. ..... 399/35

(58) Field of Classification Search ..... 399/35, 399/120, 258
See application file for complete search history.

(56) References Cited

U.S. PATENT DOCUMENTS

| | | | | |
|---|---|---|---|---|
| 7,373,092 | B2 * | 5/2008 | Tawada | 399/35 |
| 2004/0042804 | A1 * | 3/2004 | Yamamoto et al. | 399/27 |
| 2005/0220465 | A1 * | 10/2005 | Yamaoka et al. | 399/35 |

FOREIGN PATENT DOCUMENTS

| | | |
|---|---|---|
| JP | 5-15603 | 4/1993 |
| JP | 5-188835 | 7/1993 |
| JP | 5-313434 | 11/1993 |

* cited by examiner

*Primary Examiner* — David Gray
*Assistant Examiner* — Barnabas Fekete
(74) *Attorney, Agent, or Firm* — Oblon, Spivak, McClelland, Maier & Neustadt, L.L.P.

(57) ABSTRACT

In the image forming apparatus, a control unit, upon detecting that an amount of waste toner reaches a predetermined amount by a waste-toner-amount detecting unit, calculates an amount of used toner after detection through a pixel calculating unit and a printed-sheet calculating unit to accumulate the amount of used toner in a storing unit, and outputs a waste-toner-full warning when it is determined that an accumulated amount of used toner reaches a residual filling amount before a full state.

8 Claims, 6 Drawing Sheets

FIG. 8

| | TARGET (SET VALUE) | EVALUATION RESULT | |
|---|---|---|---|
| OUTPUT OF DETECTING SIGNAL FROM WASTE-TONER-AMOUNT DETECTING UNIT 202 | 80% | 130,000 RECORDING SHEETS | 81.2% |
| DETERMINATION OF WASTE-TONER MORE-NEARLY-FULL STATE | 95% | 150,000 RECORDING SHEETS | 93.8% |
| WASTE-TONER FULL STATE | 100% | 160,000 RECORDING SHEETS | 100% |

IMAGE FORMING APPARATUS

CROSS-REFERENCE TO RELATED APPLICATIONS

The present application claims priority to and incorporates by reference the entire contents of Japanese priority document 2007-230341 filed in Japan on Sep. 5, 2007.

BACKGROUND OF THE INVENTION

1. Field of the Invention

The present invention relates to an image forming apparatus that includes a container in which waste toner is collected.

2. Description of the Related Art

As is well known, when an electrostatic latent image is formed on a photosensitive element serving as an image carrier in an image forming apparatus, the latent image is developed into a toner image by toner supplied from a developing device, and the toner image is transferred and fixed onto a recording sheet.

In addition to a single-color image, an image with a plurality of colors including a full-color image is formed in the image forming apparatus. In this case, it is necessary that images having different colors are superimposed and transferred.

In some cases, the image forming apparatus includes a waste toner tank in which residual toner (waste toner) left after cleaning a photosensitive element or a transfer element is collected.

It is necessary to replace the waste toner tank when the waste toner tank is full of collected waste toner. Therefore, it is important to accurately determine replacement time to replace the waste toner tank to prevent overflow of waste toner.

Currently, various image forming apparatuses have been disclosed that include a configuration for detecting the replacement time of the waste toner tank, i.e., determining whether the waste toner tank is full of waste toner, and automatically stopping operation at the replacement time. For example, Japanese Examined Utility-Model Application publication No. H05-015603 and Japanese Patent Application Laid-open No. H05-313434 disclose a configuration in which a waste toner tank is formed of a transparent body, and it is determined whether the waste toner tank is full of waste toner based on a change of intensity of light transmitted through the waste toner tank. Moreover, Japanese Patent Application Laid-open No. H05-188835 discloses a configuration in which an amount of waste toner filled in the waste toner tank is divided into a first full level and a second full level, and two detecting sensors are provided to detect the full levels, respectively. When the first full level is detected, a first waste toner full is notified to alarm that the waste toner tank will soon be full of waste toner. When the second full level is detected, a second waste toner full is warned, which indicates that the waste toner tank is full of waste toner, and the operation is automatically stopped.

However, in the configuration disclosed in Japanese Examined Utility-Model Application publication No. H05-015603 and Japanese Patent Application Laid-open No. H05-313434, when the waste toner tank is full of waste toner, the operation makes a sudden stop. Therefore, if a user does not have a spare waste toner tank, it may take a long time to recover the operation.

In the configuration disclosed in Japanese Patent Application Laid-open No. H05-188835, it is necessary to arrange two detecting units because two-level detecting system is employed. Thus, a space to arrange the detecting units may be needed or the whole image forming apparatus may be complicated in configuration. Particularly, when the number of detecting units is increased, it may take efforts in maintenance checks or replacement of a waste toner tank, thereby causing another problem in addition to replacement of the waste toner tank.

Typically, a service engineer from a manufacturer of the apparatus often replaces a waste toner tank. Even if a user gets in contact with the service engineer when a waste toner tank is full or nearly full of waste toner, the service engineer cannot immediately respond to the request from the user. Therefore, the service engineer checks an amount of waste toner remaining in the waste toner tank by sight in regular visits and roughly determines an amount of waste toner that can be filled in the waste toner tank. When the service engineer determines that the waste toner tank will be full of waste toner by the next visit, the service engineer generally replaces the waste toner tank. Thus, it is possible to reduce interrupt time during image forming processing, that is, apparatus downtime for a user. However, when a workload difference among users is considered, the waste toner tank may be replaced even if it has much room for accommodating waste toner. This may result in useless expense for replacing the waste toner tank.

SUMMARY OF THE INVENTION

It is an object of the present invention to at least partially solve the problems in the conventional technology.

According to an aspect of the present invention, there is provided an image forming apparatus that includes an image carrier, an image forming unit that forms a toner image on the image carrier, and a container body into which waste toner collected by a cleaning mechanism after transfer of the toner image is sent from the cleaning mechanism, the image forming apparatus including a waste-toner-amount detecting unit that detects that an amount of waste toner collected in the container body reaches a predetermined amount of filled waste toner that is smaller than an amount of filled waste toner in a full state; and a control unit to an input side of which the waste-toner-amount detecting unit, a storing unit that stores an accumulated value of detection results from the waste-toner-amount detecting unit, a pixel calculating unit, and a printed-sheet calculating unit are connected and to an output side of which a waste-toner-full warning unit is connected, wherein the control unit, upon detecting that an amount of waste toner reaches the predetermined amount by the waste-toner-amount detecting unit, calculates an amount of used toner after detection through the pixel calculating unit and the printed-sheet calculating unit to accumulate the amount of used toner in the storing unit, and outputs a waste-toner-full warning when it is determined that an accumulated amount of used toner reaches a residual filling amount before the full state.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is a table representing a result of an experiment for evaluating waste toner collection.

DETAILED DESCRIPTION OF THE PREFERRED EMBODIMENTS

Exemplary embodiments of the present invention are explained in detail below with reference to the accompanying drawings.

Figure 1:
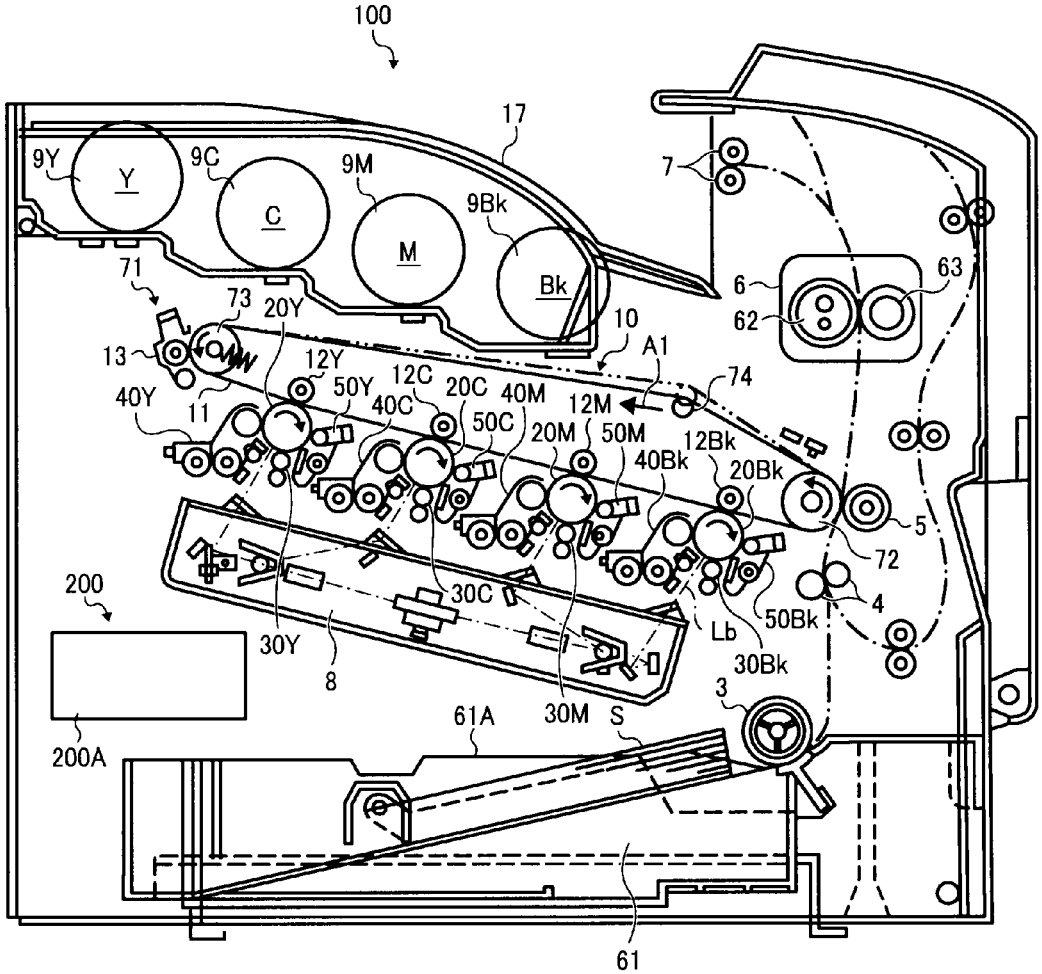
FIG. 1 is a schematic diagram of an image forming apparatus according to an embodiment of the present invention.

FIG. 1 is a schematic diagram of an image forming apparatus 100 according to an embodiment of the present invention. The image forming apparatus 100 is a tandem color printer in which an image that has a plurality of colors can be formed. The image forming apparatus 100 can be applied to, but not limited to, a printer, a copier, a facsimile device, a printing machine, or a multifunction product that has their functions.

As shown in FIG. 1, in the image forming apparatus 100, photosensitive drums 20Y, 20C, 20M, and 20Bk serving as image carriers are arranged in parallel. An image that corresponds to each color of yellow, cyan, magenta, and black can be formed on the corresponding each of the photosensitive drums 20Y, 20C, 20M, and 20Bk.

A primary transfer of each of toner images formed on the photosensitive drums 20Y, 20C, 20M, and 20Bk is performed to an intermediate transfer element 11 (hereinafter, a transfer belt) that is an endless belt that can be moved in a direction indicated by an arrow A1 opposed to each of the photosensitive drums 20Y, 20C, 20M, and 20Bk. Then, each of the images is superimposed and transferred. A secondary transfer is performed to a recording sheet S, leading to a collective transfer. The loop-shaped endless belt as a transfer belt according to the embodiment is used that is made of a resin film or rubber. Slack is prevented from occurring by a tension roller 74 that is arranged on part of a stretched surface of the transfer belt 11.

Devices that perform image forming processing along with rotation of the photosensitive drum are arranged around each of the photosensitive drums. For example, around the photosensitive drum 20Bk on which a black image is formed, a charging device 30Bk, a developing device 40Bk, a primary transfer roller 12Bk, and a cleaning device 50Bk that perform image forming processing are arranged along a direction in which the photosensitive drum 20Bk is rotated. Optical writing is performed on the photosensitive drum 20Bk by an optical scanning device 8 after the photosensitive drum 20Bk is charged. Among the photosensitive drum and the devices that perform image forming processing with respect to the photosensitive drum, a charging device 30, a developing device 40, and a cleaning device 50 except the optical scanning device 8 are accommodated together in a case and constitute a process cartridge.

While the transfer belt 11 is moved in the A1 direction, each toner image formed on each of the photosensitive drums 20Y, 20C, 20M, and 20Bk is superimposed and transferred onto the same position of the transfer belt 11 at a shifted timing from an upstream side to a downstream side in the A1 direction based on voltage application by primary transfer rollers 12Y, 12C, 12M, and 12K. The primary transfer rollers 12Y, 12C, 12M, and 12K are arranged opposed to the photosensitive drums 20Y, 20C, 20M, and 20Bk via the transfer belt 11.

The photosensitive drums 20Y, 20C, 20M, and 20Bk are arranged in this order from the upstream side of the A1 direction. Each of the photosensitive drums 20Y, 20C, 20M, and 20Bk is accommodated in a corresponding image station in which an image of a corresponding one of four colors of yellow, cyan, magenta, and black is formed.

The image forming apparatus 100 includes the four image stations in which image forming processing is performed for four colors, a transfer belt unit 10, a secondary transfer roller 5, an intermediate-transfer-belt cleaning device 13, and the optical scanning device 8. The transfer belt unit 10 that is arranged above and opposed to the photosensitive drums 20Y, 20C, 20M, and 20Bk includes the transfer belt 11 and the primary transfer rollers 12Y, 12C, 12M, and 12K. The secondary transfer roller 5 is arranged opposed to and driven by the transfer belt 11 as a transfer member. The intermediate-transfer-belt cleaning device 13 is arranged opposed to the transfer belt 11 and cleans the surface of the transfer belt 11. The optical scanning device 8 as an optical writing device is arranged below and opposed to the four image stations.

The optical scanning device 8 includes a semiconductor laser serving as a light source, a coupling lens, an fθ lens, a toroidal lens, a mirror, and a rotating polygon mirror. A writing light beam Lb (reference numerals are added to only the black image station for convenience in FIG. 1, and the same optical writing is performed in the other image stations) corresponding to each color is emitted to each of the photosensitive drums 20Y, 20C, 20M, and 20Bk, and an electrostatic latent image is formed on each of the photosensitive drums 20Y, 20C, 20M, and 20Bk.

The image forming apparatus 100 also includes a sheet feeding device 61, a pair of registration rollers 4, and a sensor (not shown). The sheet feeding device 61 includes a sheet feeding cassette 61A in which recording sheets S conveyed to between the photosensitive drums 20Y, 20C, 20M, and 20Bk and the transfer belt 11 are stacked. The registration rollers 4 send the recording sheet S conveyed from the sheet feeding device 61 to a transfer unit between each of the photosensitive drums 20Y, 20C, 20M, and 20Bk and the transfer belt 11 at a predetermined timing to match a timing at which a toner image is formed in the image station. The sensor detects that a leading edge of the recording sheet S reaches the registration rollers 4.

The image forming apparatus 100 also includes a fixing device 6, a pair of discharging rollers 7, a discharging tray 17, and toner bottles 9Y, 9C, 9M, and 9Bk. The fixing device 6 serves as a fixing unit of a roller fixing system to fix a toner image transferred to the recording sheet S on the recording sheet S. The discharging rollers 7 discharge the recording sheet S on which the toner image has been fixed out of the image forming apparatus 100. The discharging tray 17 arranged at an upper portion of the image forming apparatus 100 is used to stack recording sheets S discharged out of the image forming apparatus 100 by the discharging rollers 7. Each of the toner bottles 9Y, 9C, 9M, and 9Bk positioned below the discharging tray 17 is filled with toner of a corresponding one of four colors of yellow cyan, magenta, and black.

The transfer belt unit 10 includes the transfer belt 11, the primary transfer rollers 12Y, 12C, 12M, and 12K, as well as a driving roller 72, a driven roller 73, and the tension roller 74 by which the transfer belt 11 is supported. The transfer belt 11 is moved while opposed to each of the photosensitive drums of the process cartridges, so that a plurality of color images are sequentially superimposed and transferred. The driven roller 73 has a function of serving as a tension biasing unit with respect to the transfer belt 11. Therefore, the driven roller 73 includes a biasing unit that has a spring or the like. A transfer device 71 includes the transfer belt unit 10, the primary transfer rollers 12Y, 12C, 12M, and 12Bk, the secondary transfer roller 5, and the intermediate-transfer-belt cleaning device 13.

The sheet feeding device 61 includes the sheet feeding cassette 61A and a feeding roller 3. The sheet feeding cassette 61A is detachably arranged at a space at a lower portion of the main body of the image forming apparatus 100. The feeding roller 3 that comes into contact with a top surface of stacked recording sheets S is arranged as a feeding unit.

The feeding roller 3 is rotatably driven counterclockwise, so that the recording sheet S positioned on top of the stacked recording sheets is fed to the registration rollers 4 in cooperation with a friction separator opposed to the feeding roller 3.

The fixing device 6 includes a fixing roller 62 that has a heating source inside and a pressing roller 63 that is brought into pressure contact with the fixing roller 62. The recording sheet S on which a toner image is carried is passed through a fixing unit that is a pressure contact unit between the fixing roller 62 and the pressing roller 63, so that the toner image is fixed on a surface of the recording sheet S by heat and pressure.

The intermediate-transfer-belt cleaning device 13, which is not shown in detail in FIG. 1, includes a cleaning brush and a cleaning blade that are arranged opposed to and to be in contact with the transfer belt 11. Toner or the like that remains on the transfer belt 11 is scraped and removed by the cleaning brush and the cleaning blade to clean the transfer belt 11. The intermediate-transfer-belt cleaning device 13 includes a conveying unit (not shown) that conveys and discards the remaining toner removed from the transfer belt 11. In the image forming apparatus 100 that has the configuration shown in FIG. 1, an image formed on each of the photosensitive drums is sequentially transferred onto the transfer belt 11 and the superimposed color image is collectively transferred onto the recording sheet S through the secondary transfer roller 5. Instead of this configuration, it is possible to use another configuration in which a recording sheet S is carried on the transfer belt 11 and an image of each color is directly superimposed on the recording sheet S while the recording sheet S faces each of the photosensitive drums.

Figure 2:
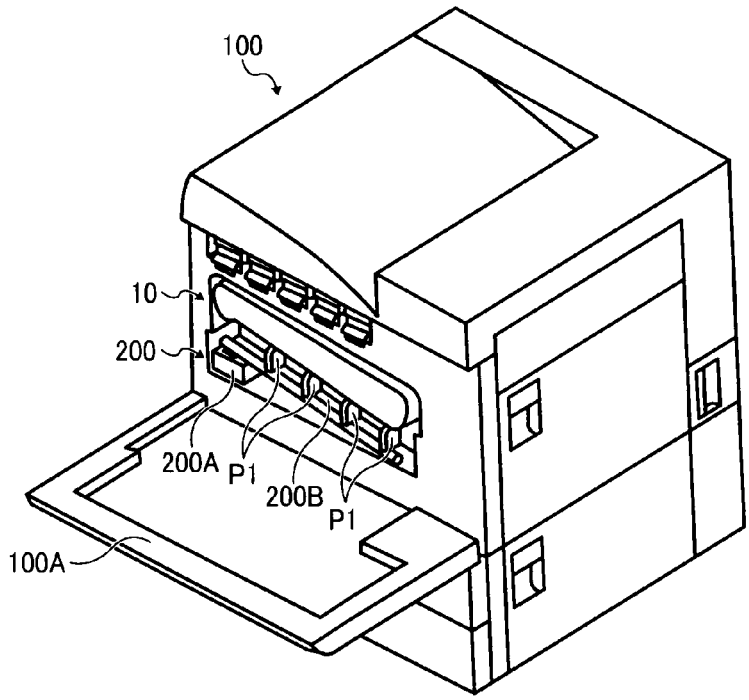
FIG. 2 is a perspective view of the image forming apparatus with a cover on a front side thereof opened.

FIG. 2 is a perspective of the image forming apparatus 100 in a state a cover 100A arranged on a side wall thereof is opened. When the cover 100A is opened, the transfer belt unit 10, a discharging pipe P1 of each of the process cartridges, and a waste toner tank 200 that are arranged inside the image forming apparatus are exposed outside. Then, the unit, the process cartridge, or the waste toner tank 200 can be replaced or subjected to maintenance.

Figure 3:
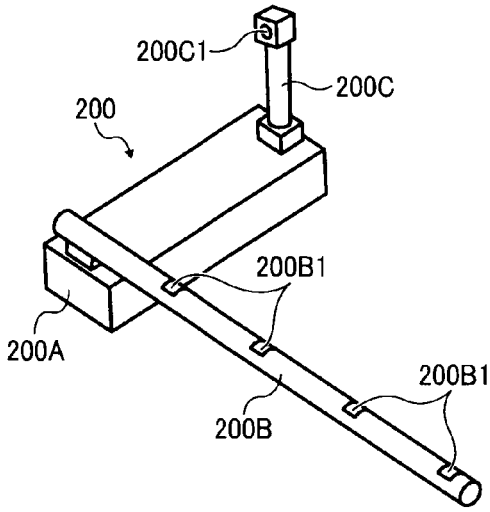
FIG. 3 is a schematic diagram of a waste toner tank of the image forming apparatus.

As shown in FIG. 3, the waste toner tank 200 includes a container 200A that can store collected waste toner and collecting pipes 200B and 200C connected to the container 200A.

The collecting pipe 200B is used to convey waste toner from a cleaning device of each of the process cartridges to the waste toner tank 200. The collecting pipe 200C is used to convey waste toner from a cleaning device arranged on the transfer belt unit 10. Connecting holes 200B1 are formed in the collecting pipe 200B, to which the discharging pipes P1 that are extended from the process cartridges are connected. A connecting hole 200C1 is formed in the collecting pipe 200C, to which a discharging pipe from the intermediate-transfer-belt cleaning device 13 can be connected.

Figure 4:
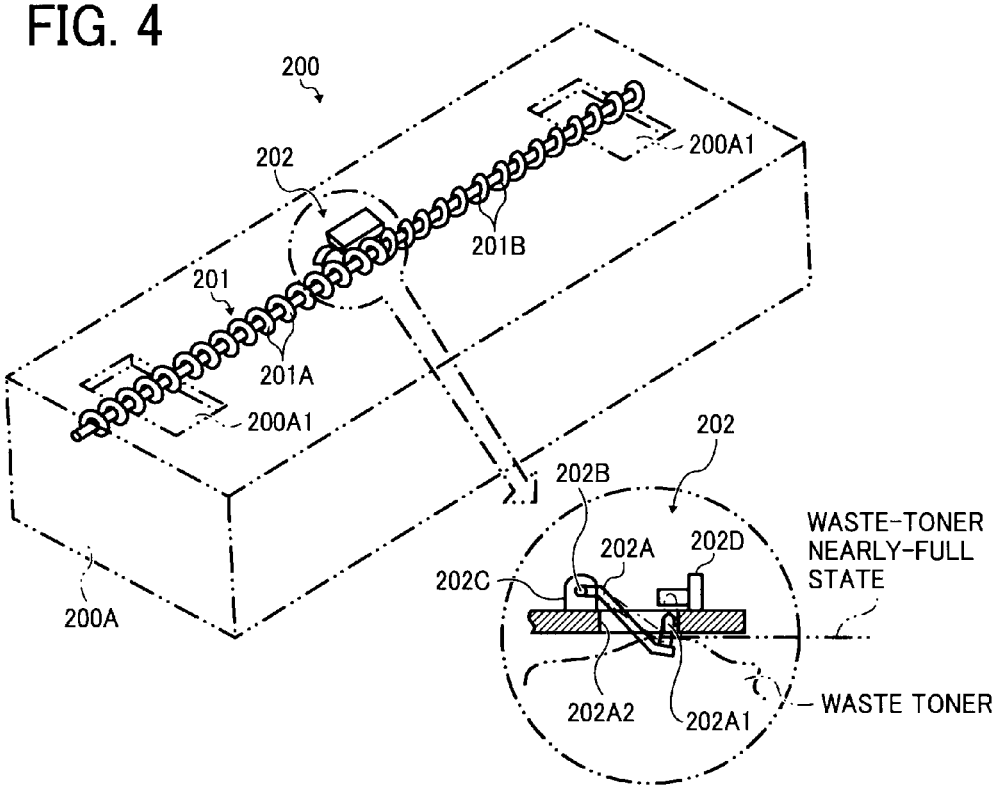
FIG. 4 is a schematic diagram for explaining an internal configuration of the waste toner tank.

FIG. 4 is a schematic diagram for explaining an internal configuration of the container 200A of the waste toner tank 200. A screw auger 201 is arranged inside the container 200A in its axial direction parallel to a longitudinal direction of the container 200A.

The screw auger 201 includes spiral wings 201A and 201B of which spiral directions are opposite while the center of the axial direction is taken as their border. With the action of the spiral wings 201A and 201B, waste toner is moved toward the center of the axial direction.

Waste toner that enters the waste toner tank 200 through waste toner inlets 200A1 is moved toward the center of the axial direction by the screw auger 201. The waste toner inlet 200A1 is formed on both edges of the container 200A in the axial direction. Thus, the waste toner is accumulated in the center of the axial direction. Waste toner from the cleaning devices can be separately sent into the waste toner tank 200 because the waste toner inlets 200A1 are formed on both edges of the container 200A in its longitudinal direction. Therefore, it is unnecessary to collectively convey waste toner from the cleaning devices, thereby preventing a larger-scale configuration to convey waste toner.

A waste-toner-amount detecting unit 202 is arranged in the center of the container 200A in its longitudinal direction.

The waste-toner-amount detecting unit 202 is indicated in the bottom right of FIG. 4 as a section view along an axial direction. The waste-toner-amount detecting unit 202 includes a filler 202A, a bracket 202C, and a photosensor 202D. The filler 202A has flexibility and is made of silicon rubber or the like. A free end of the filler 202A is inserted into a detecting opening 202A2 formed in the container 200A. A spindle 202B by which the filler 202A is swingably supported is supported by the bracket 202C. The photosensor 202D has a transmission optical path on a track on which a detecting protrusion 202A1 mounted on the free end of the filler 202A swings.

The photosensor 202D is arranged to detect that the filler 202A swings in a direction in which accumulated waste toner increases in the center of the container 200A in its longitudinal direction. Therefore, it is detected that, when the detecting protrusion 202A1 that is pushed upward by the accumulated waste toner interrupts the transmission optical path, an amount of waste toner that is filled and accumulated in the container 200A reaches a waste-toner nearly-full state in which the container 200A is nearly full of waste toner, which is lower than a level of a waste-toner full state in which the container 200A is full of waste toner. In the present embodiment, the container 200A is filled with waste toner to 80% of the waste-toner full state in the waste-toner nearly-full state. In this case, a detecting signal is output from the waste-toner-amount detecting unit 202.

Figure 5:
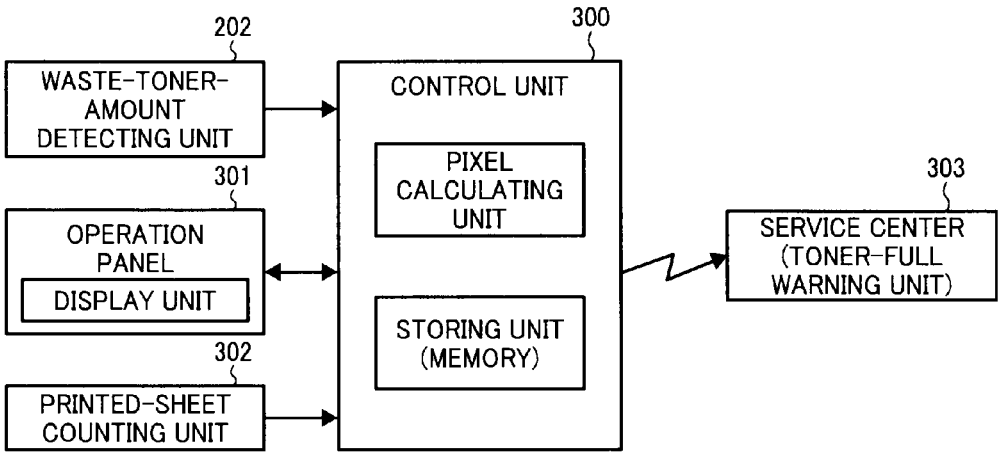
FIG. 5 is a block diagram of a control unit in the image forming apparatus.

The waste-toner-amount detecting unit 202 connected to a control unit 300 shown in FIG. 5 is used to predict and determine whether the container 200A is full of waste toner.

The control unit 300 is used for sequence control in image forming processing. The waste-toner-amount detecting unit (indicated as a waste-toner filling amount detecting sensor for convenience in FIG. 5) 202 that detects an amount of waste toner filled in the container 200A, an operation panel 301 that has a display unit, and a printed-sheet counting unit 302 are connected, on an input side, to the control unit 300 through an I/O interface (not shown). The display unit of the operation panel 301 and a warning unit 303 arranged in a service center are connected, on an output side, to the control unit 300 through a communication line.

The control unit 300 includes a storing unit (a memory) in which an input history of a detecting signal from the waste-toner-amount detecting unit 202 can be registered, a pixel calculating unit that accumulates pixel information, and the printed-sheet counting unit. In addition to the input history, pixel information and the number of printed sheets are registered in the storing unit as a map to calculate an amount of used toner. In other words, the map is associated with a total amount of used toner obtained by accumulating an amount of used toner per sheet based on pixel information and the number of printed sheets. An amount of waste toner obtained through an experiment based on the total amount of used toner is registered. Therefore, it is possible to determine an amount of waste toner filled in the container 200A by calculating an amount of used toner.

When the control unit 300*a* receives a detecting signal from the waste-toner-amount detecting unit 202, the control unit 300 refers to its input history. When the input history corresponding to the detecting signal does not exist, the detecting signal is taken as a new detection and the image forming processing is continued while warning of the waste-toner nearly-full state.

On the other hand, when an input history corresponding to a detecting signal from the waste-toner-amount detecting unit 202 exists in the control unit 300, an amount of used toner after a detecting signal is received is obtained through the pixel calculating unit and the printed-sheet counting unit 302. A residual filling amount of waste toner to be filled before the waste-toner full state is compared with an amount of waste toner based on an amount of used toner, thereby warning of a time point reaching the residual filling amount. Moreover, the control unit 300 accumulates pixel information in every image formation, and gives warning when it is determined that a value obtained by adding an amount of used toner based on the accumulated value of pixel information that has been accumulated when the control unit 300 receives a detecting signal from the waste-toner-amount detecting unit 202 to an amount of used toner based on pixel information and the number of printed sheets that correspond to the residual filling amount reaches an amount of used toner in the waste-toner full state. In other words, it is possible to select a method to give warning from two methods. In one method, attention is given only to the residual filling amount, and warning is given by predicting the waste-toner full state based on an image forming condition after detection is performed. In the other method, warning is given by determining that the amount obtained by adding the accumulated amount of used toner to the amount of used toner corresponding to the residual filling amount is equivalent to waste toner full.

Calculation is performed based on the residual filling amount in either method. A time period in which the residual filling amount runs short is calculated, so that a time period to prepare for replacement of a waste toner tank can be set before waste toner full. This makes it possible to prevent a sudden operation stop and reduce apparatus downtime in the image forming apparatus by adjusting time to replace a waste toner tank.

Next, operations of the control unit 300 are explained below based on flowcharts shown in FIGS. 6 and 7.

Warning of a time to replace a waste toner tank is given in the control unit 300 based on both reception of a detecting signal from the waste-toner-amount detecting unit 202 and calculation of the residual filling amount to be filled before the waste-toner full state based on the reception of the detecting signal. Therefore, the number of members to detect the residual filling amount is reduced.

The warning is generally given to both of a service engineer in a service center and a user of an image forming apparatus. The service engineer prepares for replacement of a waste toner tank based on the warning. The warning to the user means prediction that a waste toner tank will be full and an automatic operation stop when the waste toner tank is filled.

Figure 6:
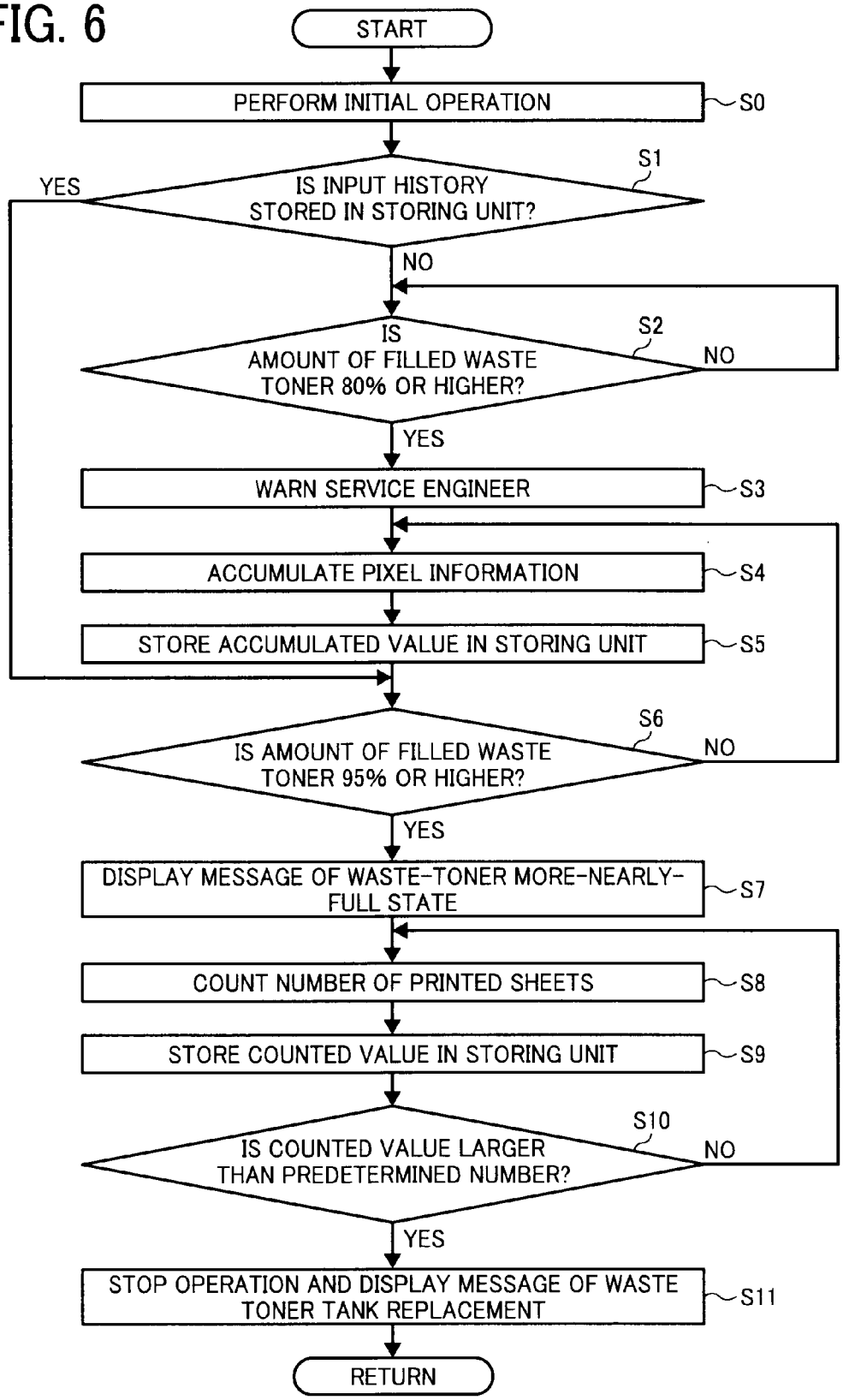
FIG. 6 is a flowchart of an operation process performed by the control unit.

As shown in FIG. 6, when the image forming apparatus starts operating or when an open/close operation of the cover ends, initial processing is performed (Step S0). During the processing, an input history based on a detecting signal of the waste-toner-amount detecting unit 202 is checked in the control unit 300 (Step S1).

It is determined whether an amount of waste toner filled in the waste toner tank 200 reaches 80% of the level at which the waste toner tank 200 is full of waste toner based on an operation of the waste-toner-amount detecting unit 202 (Step S2). When the amount of filled waste toner does not reach 80%, image forming processing is continued. When it is determined that the amount of filled waste toner reaches 80%, a new history is registered because no input history is checked at Step S1. The service engineer is warned of the waste-toner nearly-full state (Step S3).

This determination means that the waste-toner-amount detecting unit 202 operates when the waste toner tank 200 is in the waste-toner nearly-full state (80% of waste toner full). The determination result is transmitted to the warning unit 303 of the service center to inform that a replacement time for the waste toner tank 200 is approaching. Preparation for replacing the waste toner tank 200 is performed in the service center by checking the warning of the replacement time.

When a detecting signal from the waste-toner-amount detecting unit 202 is received, pixel information corresponding to an image to be formed thereafter is accumulated, which is registered in the storing unit as an amount of used toner (Steps S4 and S5).

On the other hand, when an input history has been registered and the accumulated value of pixel information is registered in the storing unit, an amount of used toner at present is calculated with respect to the residual filling amount to be filled before the waste-toner full state, and it is determined whether an amount of filled waste toner in the waste toner tank 200 reaches a predetermined amount (Step S6). In other words, after a detecting signal from the waste-toner-amount detecting unit 202 is received, pixel information corresponding to an image to be formed thereafter is accumulated point by point in the storing unit. Then, it is determined, based on the residual filling amount to be filled before the waste-toner full state, whether the amount of filled waste toner before waste toner full is in a waste-toner more-nearly-full state in which the waste toner tank 200 is further approaching the waste-toner full state (95% of waste toner full).

Determination of the waste-toner more-nearly-full state is made based on whether an accumulated value of pixel information that is registered every time an image is formed after a detecting signal is received reaches a preset value.

When the waste-toner more-nearly-full state is determined at Step S6, a message indicating the waste-toner more-nearly-full state, i.e., indicating that the waste-toner full state is approaching, is displayed on the display unit of the operation panel 301. (Step S7).

After the message is displayed, an image can be formed until waste toner full. Therefore, every time an image is formed, the number of printed sheets is accumulated and the accumulated value is registered in the storing unit (Steps S8 and S9). The residual filling amount to be filled before waste toner full with respect to 95% of waste toner full is compared with an amount of used toner based on the number of printed sheets.

The accumulated value of the number of printed sheets is registered in the storing unit, and it is determined whether the registered value reaches a predetermined value (Step S10). When the registered value reaches the predetermined value, it is determined that the waste toner tank 200 is full of waste toner and an operation of the image forming apparatus is automatically forced to stop (Step S11).

Comparison is performed, instead of using only the number of printed sheets as a basis, between the residual filling amount and an amount of used toner obtained by accumulating both the number of printed sheets and pixel information serving as a forming condition in printing. Thus, it is possible to accurately determine a time period before reaching waste toner full and time when the waste toner tank 200 is full of waste toner. Consequently, it is possible to avoid an operation of the apparatus to be stopped although the waste toner tank is actually still not full of waste toner.

Figure 7:
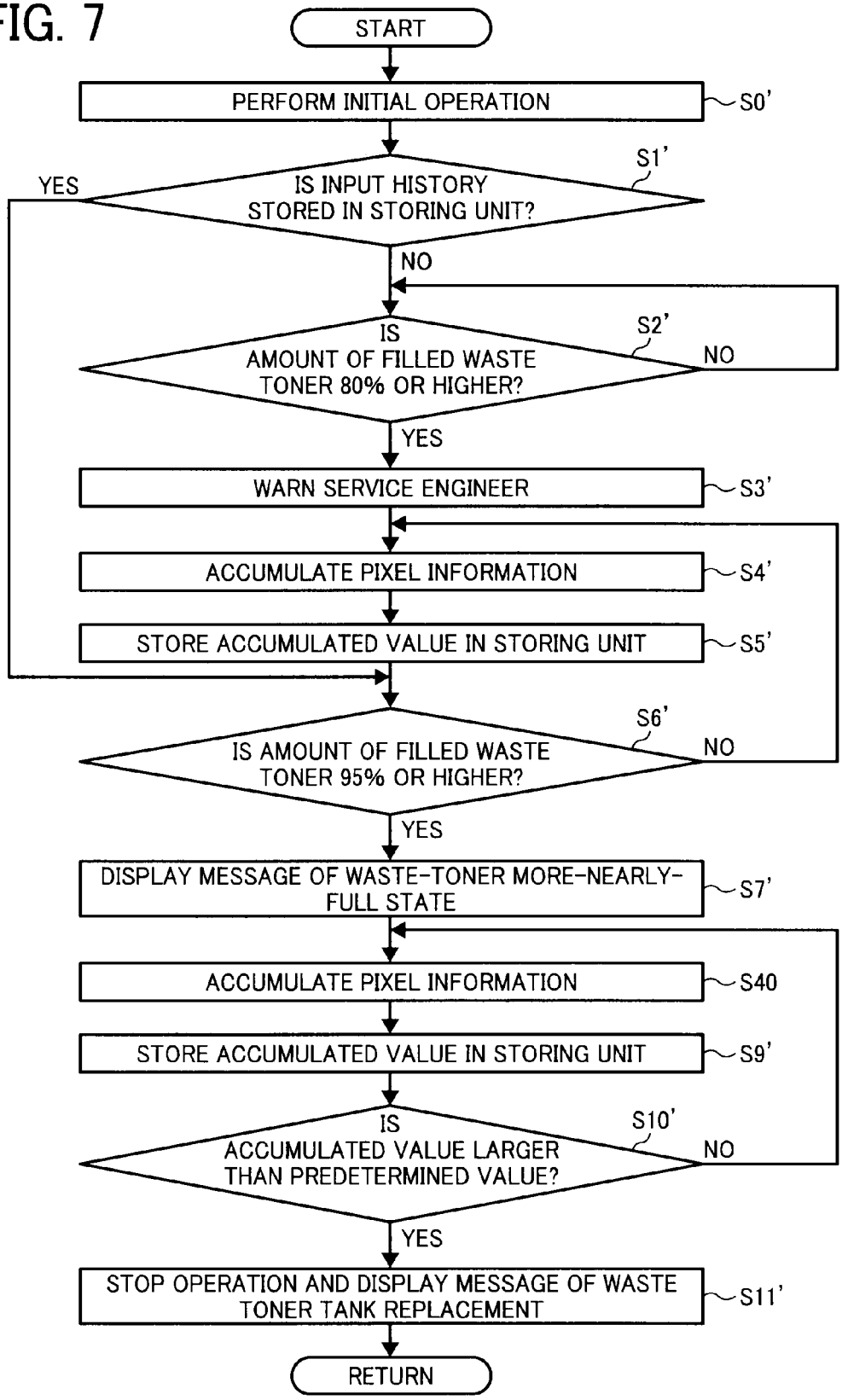
FIG. 7 is a flowchart of another operation process performed by the control unit.

FIG. 7 is a flowchart for explaining a case in which an accumulated value of pixel information is used instead of the number of printed sheets as processing after the determination of the waste-toner more-nearly-full state shown in FIG. 6. In FIG. 7, steps that have the same processing as those in FIG. 6 are represented by adding "' (dash)" thereto.

As shown in FIG. 7, when an image is formed until waste toner full after displaying the waste-toner more-nearly-full state, pixel information is accumulated for each image forming (Step S40). Then, the accumulated value is registered in the storing unit, and it is determined whether the accumulated value reaches a predetermined value (Step S10'). When the accumulated value reaches the predetermined value, an operation of the image forming apparatus is automatically forced to stop in the same manner as in FIG. 6 (Step S11').

This compelling automatic operation stop makes it possible to prevent the periphery of the waste toner tank from getting dirty because waste toner does not overflow from the waste toner tank.

The inventor actually performed evaluation in printing sheets in the image forming apparatus according to the present embodiment, and the result shown in FIG. 8 was obtained. The evaluation result shown in FIG. 8 was performed based on whether an amount of waste toner is reliably detected and notified.

Experimental conditions in the evaluation were as follows. In the waste-toner-amount detecting unit 202A, an amount of waste toner filled in the waste-toner nearly-full state was set to 80% of the waste-toner full state, and an amount of filled waste toner in the waste-toner more-nearly-full state was set to 95% of the waste-toner full state.

Based on a procedure of the flowchart shown in FIG. 6, waste toner full was detected until an operation of a converted machine of imagio MPC4500 manufactured by RICOH Company, Ltd. is forced to stop. The number of recording sheets that can be actually printed after the waste-toner more-nearly-full state is determined was taken as 10,000. A sheet printing condition was as follows, an A4 size/an image that has an image area ratio of 5%/intermittently supplied for each of two sheets/100% of full color. On about 130,000 sheets after the evaluation, a detecting signal from the waste-toner-amount detecting unit was output. Then, on about 150,000 sheets, a determination of the waste-toner more-nearly-full state was obtained. At a time point exceeding 160,000 sheets, a waste-toner-full warning was displayed on the display unit, and the image forming operation was stopped. When inside of the waste toner tank was confirmed at the final time point, the waste toner tank was almost full of waste toner. Therefore, it was confirmed that waste toner full was effectively predicted and detected. As a result, based on the evaluation result, it was confirmed that an amount of filled waste toner at the timing of each of the waste-toner nearly-full state and the waste-toner more-nearly-full state was almost the same as the target value. Thus, it was found that waste toner full can be effectively predicted and detected even with a fewer mechanical components for detection.

According to an aspect of the present invention, it is possible to reduce apparatus downtime and prevent a complicated configuration and an increase of manufacturing costs due to higher component count.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that includes an image carrier, an image forming unit that forms a toner image on the image carrier by toner supplied from a developing device, and a container body into which waste toner collected by a cleaning mechanism after transfer of the toner image is sent from the cleaning mechanism, the image forming apparatus comprising:

a waste-toner-amount detecting unit that detects that an amount of waste toner collected in the container body has reached a first amount that is smaller than an amount of filled waste toner in a full state;

a storing unit that stores an accumulated pixel value accumulated by a pixel calculating unit and an accumulated printed-sheet value accumulated by a printed-sheet calculating unit; and a calculating unit that calculates a second amount of waste toner based on a first criteria that is an amount of used toner used in the developing device utilized after the waste-toner-amount detecting unit detects that the amount of waste toner in the container body has reached the first amount of filled waste toner, wherein, after the calculating unit determines that the amount of waste toner has reached the second amount of filled waste toner, image formation is continued, and the calculating unit calculates a residual filling amount based on a second criteria that is an amount of waste toner that causes the container body to attain the full state from the second amount state, resulted from the second amount of waste toner, and compares the accumulated printed-sheet value with the residual filling amount, wherein image formation is forcibly stopped when the accumulated printed-sheet value reaches a predetermined value corresponding to an amount of the waste toner equivalent to the residual filling amount, and wherein the second criteria, different from the first criteria, is calculated based on the accumulated printed-sheet value stored in the storing unit.

2. The image forming apparatus according to claim 1, further comprising a control unit, wherein when the control unit determines that a total value obtained by adding an amount of used toner before the full state that is registered in the storing unit and an amount of used toner calculated through the pixel calculating unit and the printed-sheet calculating unit reaches an amount of filled waste toner in the full state, the control unit outputs a waste-toner-full warning.

3. The image forming apparatus according to claim 1, further comprising a control unit, wherein when the control unit determines that an amount of used toner accumulated after detection of the amount of filled waste toner by the waste-toner-amount detecting unit reaches a residual filling amount before the full state or an amount of filled waste toner in the full state, the control unit gives a warning outside the image forming apparatus.

4. The image forming apparatus according to claim 1, wherein the waste-toner-amount detecting unit optically detects an increase in an amount of waste toner filled in the container body.

5. The image forming apparatus according to claim 1, further comprising a screw auger in the container body, wherein an axial direction of the screw auger extends in a longitudinal direction of the container body, the screw auger moves waste toner contained in the container body toward a center in the axial direction, and the waste-toner-amount detecting unit is arranged in the center in the axial direction.

6. The image forming apparatus according to claim 1, wherein the image carrier and the image forming unit are accommodated in a case to constitute a process cartridge.

7. The image forming apparatus according to claim 1, wherein after the calculating unit determines that the amount of waste toner has reached a second amount of filled waste toner, a message is displayed on a display unit indicating that the waste toner has reached the second amount of waste toner.

8. The image forming apparatus according to claim 1, further including a control unit that transmits a warning when the waste-toner-amount detecting unit detects that the amount of waste toner collected in the container body reaches the first amount of filled waste toner.

* * * * *